United States Patent [19]

Ehrfeld et al.

[11] Patent Number: 4,694,548

[45] Date of Patent: Sep. 22, 1987

[54] METHOD FOR PRODUCING A SPINNING NOZZLE PLATE

[75] Inventors: Wolfgang Ehrfeld, Karlsruhe; Peter Hagmann, Leopoldshafen, both of Fed. Rep. of Germany

[73] Assignee: Kernforschungszentrum Karlsruhe GmbH, Karlsruhe, Fed. Rep. of Germany

[21] Appl. No.: 883,633

[22] Filed: Jul. 9, 1986

[30] Foreign Application Priority Data

Jul. 9, 1985 [DE] Fed. Rep. of Germany ..... 3524411

[51] Int. Cl.[4] ..... B21D 53/00; G03C 5/00; C25D 1/08

[52] U.S. Cl. ..... 29/157 C; 29/DIG. 16; 430/320; 430/324; 430/325; 430/326; 204/11

[58] Field of Search ..... 29/157 C, DIG. 16; 430/320, 324, 325, 326; 204/11

[56] References Cited

U.S. PATENT DOCUMENTS

| | | | |
|---|---|---|---|
| 3,449,221 | 6/1969 | Thomas | 204/11 |
| 4,246,076 | 1/1981 | Gardner | 204/11 |
| 4,425,777 | 1/1984 | Jeglinski | 29/157 C X |
| 4,430,784 | 2/1984 | Brooks et al. | 29/157 C |
| 4,499,177 | 2/1985 | Vollenbroek et al. | 430/326 X |
| 4,552,831 | 11/1985 | Liu | 430/325 |

FOREIGN PATENT DOCUMENTS

| | | | |
|---|---|---|---|
| 48109 | 9/1981 | Japan | 29/157 C |
| 48211 | 11/1982 | Japan | 29/157 C |
| 48312 | 12/1983 | Japan | 29/157 C |

OTHER PUBLICATIONS

Gardner, William R.; "Process for Fabrication of Ink Jet Orifices"; *Xerox Disclosure Journal*, vol. 4, No. 2 (Mar.-Apr. 1979); pp. 251-252.

Lane, R.; "Metal Membrane Nozzle for Ink Jet Printer"; *IBM Technical Disclosure Bulletin*, vol. 19, No. 10 (Mar. 1977); p. 3984.

*Primary Examiner*—Howard N. Goldberg
*Assistant Examiner*—Ronald S. Wallace
*Attorney, Agent, or Firm*—Spencer & Frank

[57] ABSTRACT

The present invention relates to a method for producing spinning nozzle plates having funnel-shaped preliminary channels in flow communication with nozzle capillaries. Two embodiments of the method are provided which use photolithographic and electrodeposition techniques. Common to both embodiments of the method is the use of a metal plate provided with funnel-shaped preliminary channels as a self-aligning irradiation mask for irradiating a photoresist layer provided on the metal plate. Nozzle capillaries subsequently defined either in an electrodeposited layer according to a first embodiment of the invention or in electrodeposited tubular projections according to a second embodiment of the invention, have an offset-free, continuous transition between themselves and the preliminary channels. Photolithographic and electrodeposition techniques may also be used to define the funnel-shaped preliminary channels in the metal plates.

21 Claims, 18 Drawing Figures

METHOD FOR PRODUCING A SPINNING NOZZLE PLATE

BACKGROUND OF THE INVENTION

1. Field of the Invention

The present invention relates to a method for producing a spinning nozzle plate, and in particular to a method for producing a spinning nozzle plate for the spinning of fibers which has funnel-shaped preliminary channels in flow communication with nozzle capillaries.

2. Background of the Art

A method of this type is disclosed and illustrated in German patent application No. P 3,517,730.6, which corresponds to U.S. patent application Ser. No. 06/863,989, filed May 16th, 1986, by Erwin Becker, and the present inventors Wolfgang Ehrfeld and Peter Hagmann.

When fibers of organic or inorganic material are produced in large-scale industrial systems, the starting material is pressed, in a flowable state, through spinning nozzle plates which are equipped with a plurality of spinning nozzle channels. In most cases, the spinning nozzle channels are composed of preliminary channels into which the material to be spun is fed and nozzle capillaries through which the material is discharged in the form of fibers, the nozzle capillaries being in flow communication with the substantially wider preliminary channels. The preliminary channels frequently have the shape of funnels which become narrower toward the nozzle capillaries with which they structurally communicate.

When preliminary channels and nozzle capillaries are produced separately, such as in the separate lithographic-electrolytic deposition steps according to U.S. patent application Ser. No. 06/863,989, an undesirable offset frequently occurs at the point of transition from the narrow end of the funnel-shaped preliminary channel to the nozzle capillary. These offsets are typically caused by photolithographic mask misalignments and/or distortions and produce undesirable perturbations in the flow of the material to be spun. The resulting spun fiber thickness and/or thickness continuity may vary unacceptably from product specifications, and a sharp offset edge can cause a non-uniform disruption in the continuity of the fiber as well.

SUMMARY OF THE INVENTION

Based on this state of the art, it is an object of the present invention to provide a method for the production of spinning nozzle plates which assures a continuous, offset-free transition from the preliminary channels to the nozzle capillaries.

This and other objects are attained by a method which uses the funnel-shaped preliminary channels as a self-aligning irradiation mask for producing the nozzle capillar,ies by photolithographic techniques. An offset-free, flush transition from each preliminary channel to a nozzle capillary is realized by providing a method wherein a metal plate having opposing first and second surfaces and having a plurality of spaced-apart preliminary channels defined therethrough are provided, each preliminary channel having a funnel-shape including a tapered end which opens at the first surface of the metal plate. A resist layer is provided on the first surface of the metal plate, which resist layer comprises a radiation-sensitive material. First portions of the resist layer are subjected to high energy radiation by irradiating the second surface of the metal plate whereby radiation is directed through the preliminary channels of the metal plate onto the resist layer, the metal plate thereby functioning as a self-aligning mask. Negatives of a plurality of nozzle capillaries are provided on the first surface of the metal plate by removing portions of the resist layer to expose portions of the first surface of the metal plate and, either before or after the removing step, depending on whether the resist layer is composed of a negative resist material or a positive resist material, filling at least the preliminary channels with a removable filler material. A galvanic layer is electrodeposited on the exposed portions of the first surface of the metal plate using the metal plate as an electrode, the galvanic layer thereby defining a plurality of nozzle capillaries. The galvanic layer is planed and the removable filler material and the negatives of the plurality of nozzle capillaries are removed, whereby the fiber spinning nozzle plate is produced.

When the resist layer is composed of a negative resist material, the negatives of the nozzle capillaries are provided by filling the preliminary channels with the removable filler material before removing portions of the resist layer, which portions are non-irradiated portions. When the resist layer is composed of a positive resist material, the negatives of the nozzle capillaries are provided by, in the order recited, removing portions of the resist layer, which portions are irradiated portions, thereby defining nozzle capillary zones; filling the preliminary channels and the nozzle capillary zones with a removable filler material; and removing non-irradiated portions of the resist layer.

Rather than defining the nozzle capillaries within an otherwise continuous galvanic layer, the nozzle capillaries may be each defined within a tubular projection extending from the first surface of the metal plate and having an outer diameter and positioning. The method then includes the further step of subjecting second portions of the resist layer, which resist layer is composed of a negative resist material, to high energy radiation by irradiating a second time through a mask positioned adjacent to the resist layer, immediately following the step of subjecting first portions of the resist layer to high energy radiation. The mask has absorber structures which correspond in diameter and positioning to the outer diameter and positioning of the tubular projections to be subsequently provided. The non-irradiated portions of the resist layer correspond to negatives of the tubular projections, such that the step of removing the non-irradiated portions of the resist layer results in the formation of tubular cavities, which cavities expose portions of the first surface. Then, the subsequent step of electrodepositing a galvanic layer provides a discontinuous galvanic layer consisting of tubular projections.

When the resist layer is composed of a positive resist material and the plurality of nozzle capillaries are each defined within a tubular projection, the method includes the further steps of, after the step of filling the preliminary channels and the nozzle capillary zones with a removable filler material, subjecting second portions of the resist layer to high energy radiation by irradiating a second time through a mask positioned adjacent to the resist layer. The mask has passages which correspond in diameter and positioning to the outer diameter and positioning of the tubular projections to be subsequently provided. The irradiated second portions of the resist layer correspond to negatives of the tubular projections and when the irradiated second portions of the resist layer are removed, tubular cavities are formed. The tubular cavities expose portions of the first surface so that the subsequent step of electrodepositing a galvanic layer provides a discontinuous galvanic layer consisting of the tubular projections.

Spinning nozzle plates having tubular nozzle capillaries may be used with particular advantage as components of spinning nozzle devices for the production of hollow fibers or multicomponent fibers. Such spinning nozzle devices are generally composed of a plurality of superposed spinning nozzle plates. Since, according to the method of the present invention, the nozzle capillaries can be manufactured with extreme precision and uniformity with respect to their individual cross-sections, as well as their mutual positioning, and the alignment of a plurality of relatively large spinning nozzle plates with respect to one another poses no major problems in the assembly of spinning nozzle devices, the manufacture of hollow fibers or multicomponent fibers having any desired cross-section and structure is possible. Thus, fibers for novel and unusual purposes can be produced by this method.

The metal plate provided for use in the foregoing method has a plurality of spaced-apart preliminary channels defined therethrough and may be fabricated by a variety of methods which are well known in the art, such as by routine machining methods. Particularly preferred for the present invention, however, is a method using photolithographic and electrodeposition techniques wherein a resist layer is provided on an electrode plate. Portions of the resist layer are then subjected to high energy radiation, which radiation has a direction, through a mask having passages. The passages correspond in cross-sectional size and shape and in positioning to that of the tapered ends of the funnel-shaped preliminary channels to be subsequently provided. The mask, resist layer and electrode plate form a unit, which unit is movably positioned in a plane perpendicular to the direction of the high energy radiation. During irradiation, the unit is moved with respect to the plane and the radiation direction. The negatives of the plurality of the funnel-shaped preliminary channels are provided on the electrode plate by removing portions of the resist layer to expose portions of the electrode plate. A galvanic layer is electrodeposited on the exposed portions of the electrode plate, the galvanic layer thereby defining a plurality of funnel-shaped preliminary channels. The galvanic layer is then planed and the negatives and the electrode plate are removed, whereby the metal plate is provided.

When the resist layer is composed of a negative resist material, the negatives of the funnel-shaped preliminary channels are provided on the electrode plate by removing non-irradiated portions of the resist layer. When the resist layer is composed of a positive resist material, the negatives of the funnel-shaped preliminary channels are provided on the electrode plate by, in the order recited, removing portions of the resist, which portions are irradiated portions, thereby defining preliminary channel zones; filling the preliminary channel zones with a removable filler material; and removing further portions of the resist layer which further portions are non-irradiated portions.

The movement of the unit with respect to the plane and the radiation direction during irradiation may be movement by rocking the unit about the plane in at least one direction, whereby the irradiated portions of the resist layer have a trapezoidal funnel shape. Alternately, the movement of the unit may be by tumbling the unit about the plane whereby the resist layer have a conical funnel shape. The high energy radiation, moreover, is preferably X-ray radiation generated by an electron synchrotron.

The offset-free, continuous transition from preliminary channel to nozzle capillary realized by the present invention is also achievable with nozzle capillaries having a special shape. For example, star-shaped cross-sections, as well as nozzle capillaries having circular cross-sections, etc., are achievable.

BRIEF DESCRIPTION OF THE DRAWING

The individual steps of the method according to the present invention will be described below with reference to the drawing figures which schematically show in cross-section various stages in the production of a spinning nozzle plate:

in FIG. 7, the non-irradiated portions of the negative resist layer of FIG. 6, and in FIG. 7*a*, the irradiated portions of the positive resist layer of FIG. 6*a*;

DESCRIPTION OF THE PREFERRED EMBODIMENTS

Figure 1:
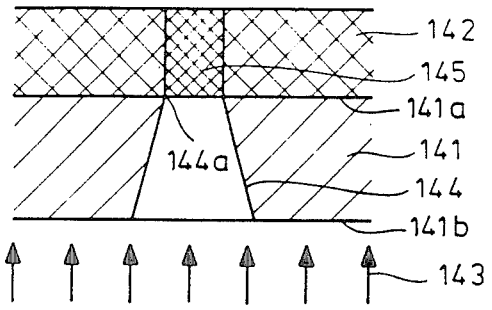
FIG. 1 shows irradiation of a resist layer through the funnel-shaped preliminary channels of a metal plate, which metal plate is functioning as a self-aligning mask in a first embodiment of the method as shown in FIGS. 1 through 4.

FIG. 1 shows a metal plate 141 having funnel-shaped preliminary channels 144. The side of metal plate 141, first surface 141*a*, at which tapered ends 144*a* of the preliminary channels 144 open, is provided with a resist layer 142 of radiation-sensitive, negative resist material. Portions 145 of resist layer 142 are irradiated through the preliminary channels 144 by irradiating the other side of plate 141, second surface 141*b*, with high energy radiation 143, for example with X-ray radiation 143 from an electron synchrotron, thereby causing changes in the irradiation-sensitive, negative photoresist material which render the irradiated portions 145 substantially insoluble in a developer (not shown). The irradiated portions 145 have a cross-sectional shape and size which corresponds to the cross-sectional shape and size of the tapered ends 144*a* of the preliminary channels 144 and have a volume which corresponds in size and shape to that of the nozzle capillaries.

Examples of negative resist materials useful in the present invention are polystyrene-based materials, many commercially-available variations of such formulations being available. Preferred developers for polystyrene-based negative resist materials are liquid developers useful as an immersion bath or spray and are composed of a mixture of ketones and higher alcohols. A non-irradiated resist layer of this negative type is readily soluble in the developer.

A resist layer 142 may be provided on metal plate 141 in any one of several ways. The preliminary channels 144 of the metal plate 141 may be filled with a removable filler material and the resist layer 142 coated in any one of several methods including flow coating, roller coating, dip coating, etc. A removable filler 152 is shown filling the preliminary channels 144 in FIG. 2, for example. Since the removable filler material is not transmissive in a thick layer to high energy radiation, it is removed prior to the irradiation step.

Alternately, if the cross-sectional area of the tapered ends 144*a* of the preliminary channels 144 are sufficiently small in view of the viscosity, as adjusted such as with solvents and/or thickeners, of the photoresist material to be coated thereon, for example, on the order of 0.1 millimeter square or less, the resist layer may be coated by roller coating, flow coating, etc., directly onto the first surface 141*a* of the metal plate, despite the presence of the tapered ends 144*a* which open at the first surface 144*a*.

The photoresist layers 142 may be provided by yet another method variation in which a self-supporting sheet of the photoresist material is prepared and is laminated onto the first surface 141*a* of the metal plate 144 while tacky and/or by the application of heat and pressure, such as by rolling the outer surface of the self-supporting resist material with a heated roller under pressure. In a further variation of this alternate method, a thin adhesive layer (non shown) may be coated onto the first surface 141*a* of the metal plate 144 and a self-supporting photoresist material applied to the adhesive layer, with or without the simultaneous application of heat and pressure.

After irradiation of the resist layer 142 through metal plate 141, using metal plate 141 as a self-aligning mask, if the preliminary channels 144 are not already filled with removable filler material 152, they are filled with removable filler material 152 of a type which bonds or can be caused to bond to the inside walls of preliminary channels 144 as well as to the portions of the resist layer 142 at the interfaces thereof with preliminary channels 144. This removable filler material 152 is composed of, for example, a mixture of an epoxide resin and an internal separating agent. Removable filler material is preferably chemically removable by dissolution in a solvent, such as by immersing or spraying. It is necessary that the removable filler material 152 be substantially resistant to the developers used in conjunction with developing the photoresist materials after irradiation.

Figure 2:
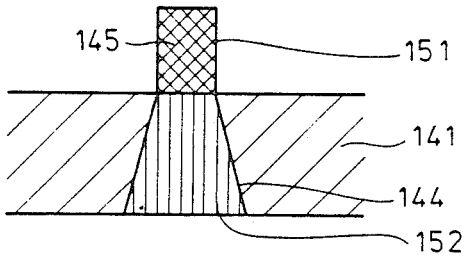
FIG. 2 shows the funnel-shaped preliminary channels of the metal plate of FIG. 1 filled with a removable filler material, after which negatives of the nozzle capillaries are provided by removing non-irradiated portions of a resist layer composed of a negative resist material.

With reference to FIG. 2, after filling preliminary channels 144 with removable filler material 152, the non-irradiated portions of resist layer 142 are removed, for example, by immersing resist layer 142 in liquid developer (not shown) leaving only negatives 151 of nozzle capillaries on metal plate 141. Negatives 151 are shown in FIG. 2 as having a column-shape, the cross-section of negatives 151, however, need not be circular, but may have virtually any shape, such as the shape of a star, a rectangle, a square, a triangle, etc.

Figure 3:
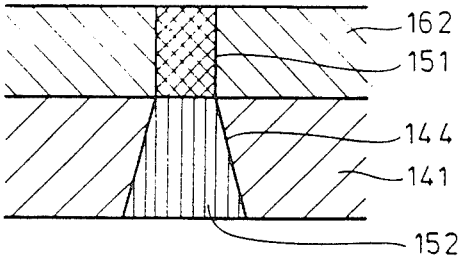
FIGS. 3 and 3*a* show electrodepositing a galvanic layer on the surface of the metal plate of FIGS. 2 and 2*c*, respectively, after providing the surface with negatives of the nozzle capillaries.

With reference to FIG. 3, metal plate 141 serves as an electrode during the electrodeposition of a galvanic layer 162 onto the exposed portions of first surface 141*a* of the metal plate 141. The electrodeposited galvanic layer 162 thus surrounds and includes the negatives 151 of nozzle capillaries, however, the galvanic layer 162 has a thickness which does not substantially exceed the thickness of the negatives 151, since the negatives 151 are to be removed in a subsequent step.

Galvanic layer 162 is then planed to achieve a desired surface finish and thickness, which thickness preferably does not exceed that of negatives 151. Negatives 151 of nozzle capillaries are then removed in a process, such as chemically dissolving the developer-insensitive, irradiated resist material which composes the negatives 151 in a commercially-available liquid stripper bath (not shown). The removable filler material 152 is preferably simultaneously removed in the same operative step as for the removal of the negatives 151, for example in the stripper bath. Alternately, filler material 152 may be removed in a process such as immersing in a bath of, or spraying with, a solvent or stripper material selected on the basis of the chemical and/or physical properties of the specific removable filler material.

Figure 4:
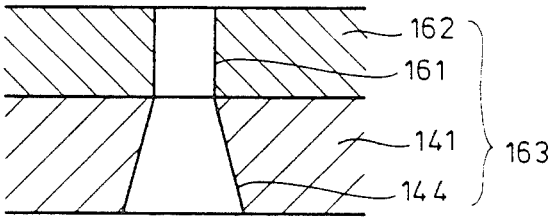
FIG. 4 shows a finished spinning nozzle plate according to the first embodiment of the invention with an offset-free, flush transition between preliminary channel and nozzle capillary formed by planing the galvanic layer of FIGS. 3 and 3*a* and removing the filler material and the negatives of the nozzle capillaries.

A finished spinning nozzle plate 163 is shown in FIG. 4. Spinning nozzle plate 163 has funnel-shaped preliminary channels 144 in flow communication with nozzle capillaries 161, the structural connection therebetween being continuous, that is, flush and without a seam, and having no offsets. In this manner, the recited objects according to the present invention, which uses the funnel-shaped preliminary channels 144 as a self-aligning irradiation mask during the photolithographic/electrodeposition formation of nozzle capillaries, are accomplished.

Figure 2A:
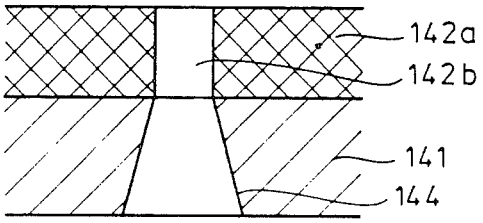
FIGS. 2*a*, 2*b* and 2*c* show negatives of the nozzle capillaries provided by removing irradiated portions of a resist layer composed of a positive resist material to define capillary zones (FIG. 2*a*), filling the funnel-shaped preliminary channels and the nozzle capillary zones with a removabley filler material (FIG. 2*b*), and removing non-irradiated portions of the resist layer (FIG. 2*c*)

With reference again to FIG. 1, if a radiation-sensitive, positive resist material is used to form a resist layer 142, now identifed as resist layer 142*a*, the sequence of formative steps varies somewhat as shown in FIGS. 2*a*, 2*b*, 2*c*, and 3*a*. After irradiation through the metal plate 141, irradiated portions are removed as shown in FIG. 2*a*, for example, with a liquid developer (not shown).

Many commercially-available positive photoresist materials are available. As an example, polymethylmethacrylate-based resist materials may be used. Preferred developers for polymethylmethacrylate-based positive photoresist materials are liquid developers useful as a immersion bath or spray and are composed of a mixture of diethylene glycol monobutyl ether, morpholine, ethanolamine and water.

Figure 2B:
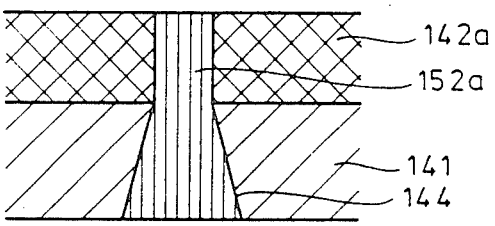

The step of removing irradiated portions shown in FIG. 2*a* defines a nozzle capillary zone 142*b*. As shown in FIG. 2*b*, nozzle capillary zones 142*b* and preliminary channels 144 are filled with a removable filler material 152*a*, which filler material 152*a* is substantially less soluble than the positive resist material of resist layer 142*a*.

Figure 2C:
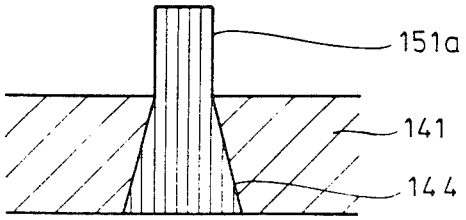

The non-irradiated portions of resist layer 142*a* are removed to produce negatives 151*a* of nozzle capillaries on metal plate 141 as shown in FIG. 2*c*. Removal of the non-irradiated portions of resist layer 142*a* is accomplished, for example, by immersion thereof in a solvent which selectively dissolves the non-irradiated portions of resist layer 142*a* without dissolving the removable filler material 152*a*. Selection criteria for such solvents are well known in the art. Generally, the developer for the resist material may be used.

Figure 3A:
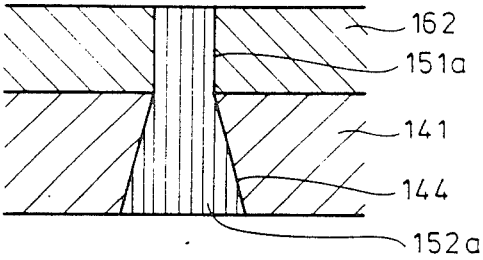

Galvanic layer 162 is produced as previously described by electrodeposition using metal plate 141 as an electrode, as shown in FIG. 3*a*. The galvanic layer 162 is planed to a desired surface finish and thickness and the removable filler material, which includes the filler material 152*a* in the preliminary channels and the filler material 151*a* which constitutes the negatives 151*a*, is removed. Again, a spinning nozzle plate 163 is produced as shown in FIG. 4.

Figure 5:
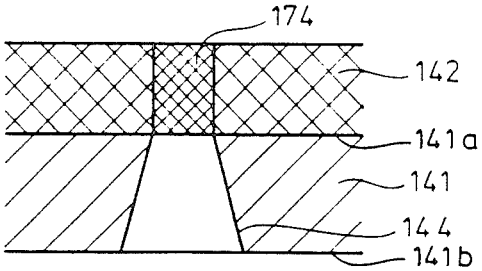
FIG. 5 shows irradiation of a resist layer through the funnel-shaped preliminary channels of a metal plate, which metal plate is functioning as a self-aligning mask in a second embodiment of the method as shown in FIGS. 5 through 9 wherein the nozzle capillaries are defined within tubular projections.
Figure 6:
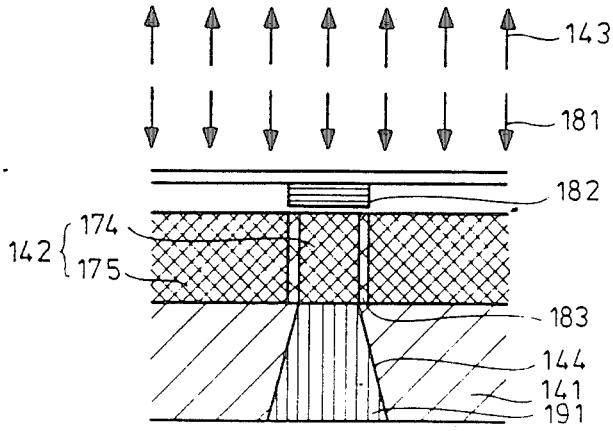
FIG. 6 shows irradiation of the negative resist layer of FIG. 5 a second time through a mask having absorber structure which correspond in diameter and positioning to that for tubular projections to be subsequently provided, so that non-irradiated portions of the resist layer correspond to negatives of the tubular projections, the preliminary channels being filled with a removable filler material.

The method according to the present invention can also be used for the production of spinning nozzle plates having nozzle capillaries defined within tubular projections. In this second embodiment according to the invention, a metal plate 141 having funnel-shaped preliminary channels 144 defined therethrough is provided with a resist layer 142 along a first surface 141*a* thereof and is again employed as a self-aligning irradiation mask as shown in FIG. 5. High energy radiation, that is, radiation which is actinic with respect to resist layer 142, is directed upon a second surface 141*b* of the metal plate 141 such that a first portion 174 of resist layer 142 is irradiated through the preliminary channels 144 of metal plate 141. If resist layer 142 is composed of a negative resist material, a mask having absorber structures 182 corresponding to the outer diameters of the tubular projections to be subsequently provided is employed for irradiation of a second portion 175 of resist layer 142 with high energy radiation 181 as shown in FIG. 6. Absorber structures 182 may be spaced apart from or placed in contact with resist layer 142, and in alignment so that non-irradiated portions of the resist layer 142 correspond to negatives 183 of the tubular projections to be subsequently provided. Thus, as shown in FIG. 6, irradiated first and second portions 174 and 175, respectively, surround non-irradiated portions 183 of resist layer 142. Preliminary channels 144 are then filled with a removable filler material 191.

Figure 7:
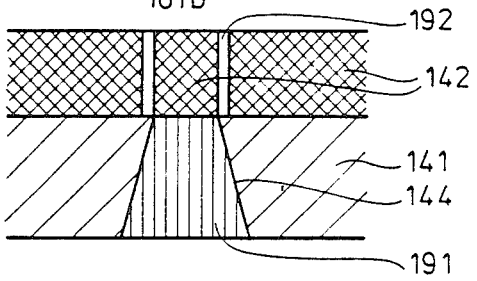
FIGS. 7 and 7*a* show tubular cavities formed by 15. removing the negatives of the tubular projections thereby forming tubular cavities and exposing portions of the metal plate.

With reference to FIG. 7, tubular cavities 192 are provided in resist layer 142 by removing non-irradiated portions, i.e., the negatives 183, for example, by chemically removing same by immersion or spraying with a liquid developer. Tubular cavities 192 extend down to the first surface 141*a* of the metal plate 141 exposing portions of same.

Figure 8:
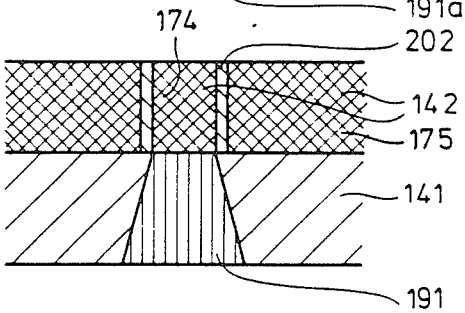
FIG. 8 shows electrodepositing a galvanic layer, which is a discontinuous galvanic layer consisting of tubular projections, onto the portions of the metal plate exposed by the tubular cavities formed in FIGS. 7 and 7*a*.

A galvanic layer or structure is shown in FIG. 8 as having the form of tubular projections 202 and is provide by electrodeposition using metal plate 141 as an electrode. The galvanic layer or structure in the form of tubular projections 202 are, for example, metal structures prepared by immersion of at least the tubular cavities 192 and the exposed portions of first surface 141*a* of the metal plate 141 in an electrodeposition bath which may be, for example, a chloride-free nickel sulfamate bath maintained at a temperature of 52° C. The bath may also include additional components including boric acid, used to buffer the electrolyte to a pH=4, and a wetting agent to prevent pore formation.

Figure 9:
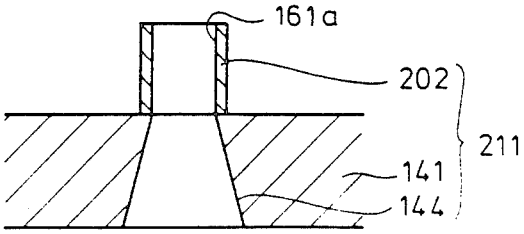
FIG. 9 shows a finished spinning nozzle plate according to the second embodiment of the invention with an offset-free, flush transition between preliminary channel and nozzle capillaries formed by planing the galvanic layer of FIG. 8 and removing the filler material and the negatives of the nozzle capillaries.

The galvanic layer in the form of tubular projections 202 is then planed as before and the first portion 174 and second 175 of resist layer 142, as well as filler material 191 are both removed so that a spinning nozzle plate 211 is provided as shown in FIG. 9. The spinning nozzle plate 211 according to the second embodiment of the invention has funnel-shaped preliminary channels 144 in flow communication with nozzle capillaries 161*a*, which nozzle capillaries 161*a* are defined by tubular projections 202.

The preferred high energy radiation 143 and/or 181 employed is X-ray radiation generated by an electron synchrotron having a characteristic wavelength $\lambda_c=0.2$ nm. Absorber structures 182 useful in X-ray masks are composed of, for example, about 16 microns of gold which is essentially impermeable to X-ray radiation. The gold absorber structures 182 may be carried on a mask substrate which is substantially permeable to X-ray radiation, such as a mask substrate of beryllium in sheet form and having a thickness of approximately 20 microns.

Figure 6A:
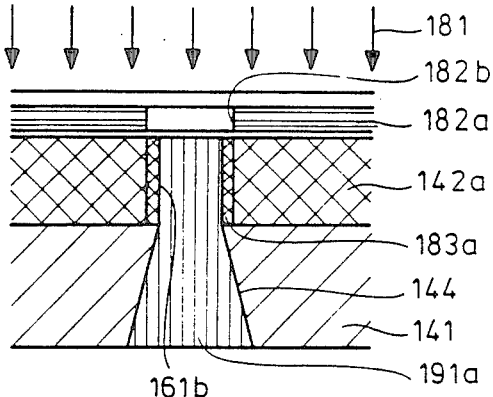
FIG. 6*a* shows irradiation of the positive resist layer of FIG. 5 a second time after removing the portions of the resist layer irradiated in FIG. 5 to define nozzle capillary zones and after subsequently filling the nozzle capillary zones and the preliminary channels with a removable filler material, the second irradiation being through a mask having passages which correspond in diameter and positioning to that for tubular projections to be subsequently provided, so that irradiated portions of the resist layer correspond to negatives of the tubular projections.

If a positive resist material is used to provide a resist layer 142*a* in the second embodiment of the method according to the present invention, the irradiated portions of resist layer 142*a* (not shown) correspond to negatives 174*a* (not shown) of nozzle capillaries and are provided by, in the order recited, removing irradiated portions 174*a* by chemically removing same, for example, by immersion thereof in a bath of liquid developer, thereby defining nozzle capillary zones 161*b* (FIG. 6*a*), and filling the preliminary channels 144 and the nozzle capillary zones 161*b* with a removable filler material 191*a*. Then, as shown in FIG. 6*a*, second portions 183*a* of the resist layer 142*a* are subjected to high energy radiation 181 by irradiating a second time through a mask positioned adjacent to resistant layer 142*a*, either in spaced apart relation thereto or in contact therewith, after the step of filling the preliminary channels 144 and the nozzle capillary zones 161*b* with removable filler material 191*a*. The mask has absorber structures 182*a* provided with passages 182*b* which are permeable to high energy radiation 181. Passages 182*b* have diameters and positioning which correspond to the outer diameter and positioning of the tubular projections 202 to be subsequently provided.

Figure 7A:
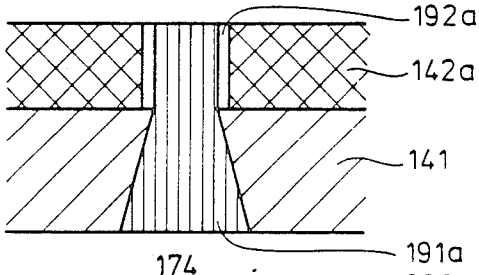

The irradiated second portions 183*a* of the resist layer 142*a* correspond to negatives 174*a* of the tubular projections 202. Irradiated second portions 183*a* are thus tubular and are produced between removable filler material 191*a* and the non-irradiated portions of positive resist material of layer 142*a*. Irradiated portions 183*a* are then removed, such as by immersion or spraying with a liquid developer or solvent therefore, so that tubular cavities 192*a* are formed as shown in FIG. 7*a*. Electrodeposition, planing, and removing the filler material 191*a* and the remaining positive resist layer 142*a* are analogous to the description regarding FIG. 8 for a negative resist system. Thus, the novel spinning nozzle plate 211 as shown in FIG. 9 according to the second embodiment of the method of the present invention results and has the advantages previously described.

Figure 10:
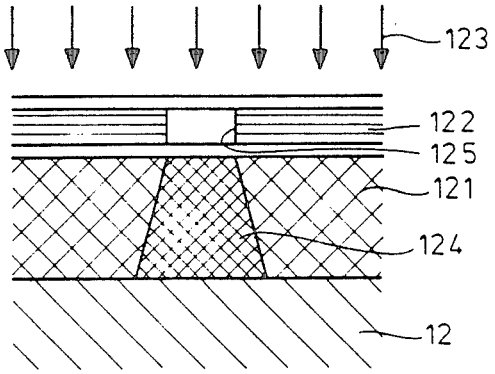
FIG. 10 relates to a method for providing a metal plate having funnel-shaped preliminary channels and shows irradiation through a mask of a unit formed by an electrode plate provided with a resist layer composed of a negative resist material and the mask, which mask has passages, the units being movably positioned in a plane perpendicular to the direction of the irradiation and being moved about the plane during irradiation.
Figure 11:
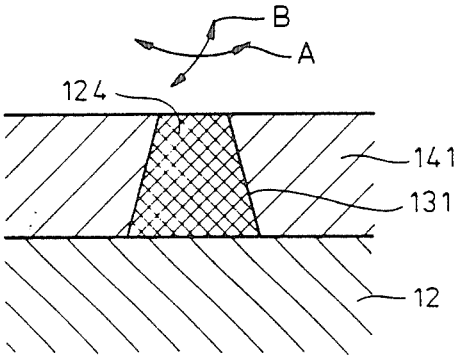
FIG. 11 shows electrodeposition of a galvanic layer onto exposed portions of the electrode plate of FIG. 10, after removing the non-irradiated portions of the resist layer to form negatives of the funnel-shaped preliminary channels on exposed portions of the electrode plates.
Figure 12:
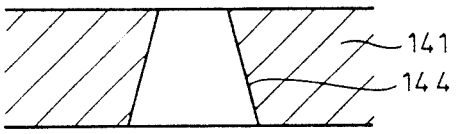
FIG. 12 shows a finished metal plate having funnel-shaped preliminary channels after the electrode plate and the negatives of the funnel-shaped preliminary channels according to FIG. 11 have been removed.

With reference to FIGS. 10, 11 and 12, metal plate 141 having funnel-shaped preliminary channels 144 can similarly be produced by photolithographic/electrodeposition methods. The misalignment problems typical of conventional machining operations can be substantially eliminated by photolithographic methods. Thus, an electrode plate 12 may be provided with a resist layer 121 composed of either a negative or a positive resist material. Plate 12 is a continuous plate and the resist layer 121 may be applied thereto by conventional coating means, such as by roller or dip coating. A mask 122 is disposed a short distance away from the surface of resist layer 121 as shown in FIG. 10. Mask 122 is comprised of absorber structures having passages 125 defined therein. Passages 125 permit the passage of high energy radiation therethrough and have a cross-sectional size and shape and positioning corresponding to that of the tapered ends 144*a* of the funnel-shaped preliminary channels 144 to be subsequently provided.

Preferably, high energy radiation 123 is parallel X-ray radiation 123 from an electron synchrotron. As shown in FIG. 10, mask 122, resist layer 121 and electrode plate 12 form a unit 122, 121, 12 which is movably positioned in a plane perpendicular to the direction of the high energy radiation 123. The unit 122, 121, 12 is shown as occupying the plane and is moved with respect to the plane and the radiation direction during irradiation of the resist layer 121. When trapezoidal funnel-shaped preliminary channels 144 are desired, the unit is moved during irradiation by rocking the unit about the plane in at least one direction, the rocking motion being indicated in FIG. 10 by arrows A. Rocking may take place in two mutually perpendicular directions, so that rocking of the unit takes place about an imaginary fulcrum, first in a direction parallel to the plane of the paper and second in a direction perpendicular to the plane of the paper. When conical funnel-shaped preliminary channels 144 are desired, the unit is moved during irradiation by rolling the unit about the plane symmetrically and conically as indicated in FIG. 11 by arrows B. Funnel-shaped preliminary channels 144 having other shapes are possible by varying the nature of the movement of the unit during irradiation.

If the precision of the preliminary channels 144 need not be great, irradiation from a highly divergent, planar radiation source may take the place of rolling the unit during irradiation. Other variations will be immediately obvious to the artisan.

When the resist layer 121 is composed of a negative resist material, negatives 131 of the funnel-shaped preliminary channels 144 are provided on the electrode plate 12 by removing non-irradiated portions of the resist layer 121, by means of, for example, a liquid developer (not shown). The irradiated portions 124 of resist layer 121 are rendered soluble only with greater difficulty by the irradiation step compared to the non-irradiated portions of the resist layer 121.

Alternately, when the resist layer 121 is composed of a positive resist material, negatives 131 of funnel-shaped preliminary channels 144 are provided on the electrode plate 12 by process steps analogous to those shown in FIGS. 2*a*, 2*b* and 2*c*. Thus, in the order recited, irradiated portions 124 of the resist layer 121 are removed thereby defining preliminary channel zones 124, the preliminary channel zones 124 are filled with a removable filler material, and the non-irradiated portions of resist layer 121 are removed.

As shown in FIG. 11, whether generated using a positive resist material or a negative resist material, a galvanic layer 141 is electrodeposited onto the exposed surfaces of electrode plate 12. The galvanic layer 141 is planed and negatives 131 and electrode plate 12 are removed so that a metal plate 141 having funnel-shaped preliminary channels 144 is provided as shown in FIG. 12.

The present disclosure relates to the subject matter disclosed in German patent application Ser. No. P 35 24 411.9, filed July 9th, 1985, the entire specification of which is incorporated herein by reference.

It will be understood that the above description of the present invention is susceptible to various modifications, changes and adaptations, and the same are intended to be comprehended within the meaning and range of equivalents of the appended claims.

What is claimed is:

1. A method for producing a spinning nozzle plate having funnel-shaped preliminary channels in flow communication with nozzle capillaries, the method comprising the steps of:

a. providing a metal plate having opposing first and second surfaces and having a plurality of spaced-apart preliminary channels defined therethrough, each preliminary channel having a funnel-shape including a tapered end which opens at the first surface of the metal plate;

b. providing a resist layer on the first surface of the metal plate, which resist layer comprises a radiation-sensitive material;

c. subjecting first portions of the resist layer to high energy radiation by irradiating the second surface of the metal plate whereby radiation is directed through the preliminary channels of the metal plate onto the resist layer, the metal plate thereby functioning as a self-aligning mask;

d. providing negatives of a plurality of nozzle capillaries on the first surface of the metal plate by removing portions of the resist layer to expose portions of the first surface of the metal plate and filling at least the preliminary channels with a removable filler material, e. electrodepositing a galvanic layer on the exposed portions of the first surface of the metal plate using the metal plate as an electrode, the galvanic layer thereby defining a plurality of nozzle capillaries;

f. planing the galvanic layer; and g. removing the removable filler material and the negatives of the plurality of nozzle capillaries.

2. The method according to claim 1, wherein the resist layer is composed of a negative resist material, and wherein the negatives of the plurality of nozzle capillaries are provided by filling the preliminary channels with the removable filler material before removing portions of the resist layer, which portions are non-irradiated portions.

3. The method according to claim 2, wherein the plurality of nozzle capillaries are each defined within a tubular projection extending from the first surface of the metal plate and having an outer diameter and positioning, wherein the method includes the further step of subjecting second portions of the resist layer to high energy radiation by irradiating a second time through a mask positioned adjacent to the resist layer, immediately following the step of subjecting first portions of the resist layer to high energy radiation, the mask having absorber structures which correspond in diameter and positioning to the outer diameter and positioning of the tubular projections to be subsequently provided, the non-irradiated portions of the resist layer corresponding to negatives of the tubular projections, and wherein the step of removing the non-irradiated portions of the resist layer results in the formation of tubular cavities, which cavities expose portions of the first surface, and the subsequent step of electrodepositing a galvanic layer provides a discontinuous galvanic layer consisting of said tubular projections.

4. The method according to claim 3, wherein the metal plate having a plurality of spaced-apart preliminary channels defined therethrough is provided by a method including the steps of:

a. providing a resist layer on an electrode plate;

b. subjecting portions of the resist layer to high energy radiation, which radiation has a direction, through a mask having passages, which passages correspond in cross-sectional size and shape and in positioning to that of the tapered ends of the funnel-shaped preliminary channels to be subsequently provided, the mask, resist layer and electrode plate forming a unit, which unit is movably positioned in a plane perpendicular to the direction of the high energy radiation and is moved with respect to said plane and said radiation direction during irradiation;

c. providing negatives of the plurality of funnel-shaped preliminary channels on the electrode plate by removing portions of the resist layer to expose portions of the electrode plate;

d. electrodepositing a galvanic layer on the exposed portions of the electrode plate, the galvanic layer thereby defining a plurality of funnel-shaped preliminary channels;

e. planing the galvanic layer; and f. removing the negatives and the electrode plate.

5. The method according to claim 4, wherein the resist layer is composed of a negative resist material and wherein negatives of the funnel-shaped preliminary channels are provided on the electrode plate by removing non-irradiated portions of the resist layer.

6. The method according to claim 4, wherein the resist layer is composed of a positive resist material and wherein negatives of the funnel-shaped preliminary channels are provided on the electrode plate by, in the order recited, removing portions of the resist layer, which portions are irradiated portions, thereby defining preliminary channel zones; filling the preliminary channel zones with a removable filler material; and removing further portions of the resist layer, which further portions are non-irradiated portions.

7. The method according to claim 4, wherein the unit is moved during irradiation by rocking the unit about the plane in at least one direction, whereby the irradiated portions of the resist layer have a trapezoidal funnel shape.

8. The method according to claim 4, wherein the unit is moved during irradiation by tumbling the unit about the plane, whereby the irradiated portions of the resist layer have a conical funnel shape.

9. The method according to claim 1, wherein the resist layer is composed of a positive resist material, and wherein the negatives of the nozzle capillaries are provided by, in the order recited, removing portions of the resist layer, which portions are irradiated portions, thereby defining nozzle capillary zones; filling the preliminary channels and the nozzle capillary zones with a removable filler material; and removing further portions of the resist layer, which further portions are non-irradiated portions.

10. The method according to claim 9, wherein the plurality of nozzle capillaries are each defined within a tubular projection extending from the first surface of the metal plate and having an outer diameter and positioning, wherein the method includes the further steps of, after the step of filling the preliminary channels and the nozzle capillary zones with a removable filler material, subjecting second portions of the resist layer to high energy radiation by irradiating a second time through a mask positioned adjacent to the resist layer, the mask having passages which correspond in diameter and positioning to the outer diameter and positioning of the tubular projections to be subsequently provided, the irradiated second portions of the resist layer corresponding to negatives of the tubular projections; and removing irradiated second portions of the resist layer to form tubular cavities, which cavities expose portions of the first surface so that the subsequent step of electrodepositing a galvanic layer provides a discontinuous galvanic layer consisting of said tubular projections.

11. The method according to claim 10, wherein the metal plate having a plurality of spaced-apart preliminary channels defined therethrough is provided by a method including the steps of:

a. providing a resist layer on an electrode plate;

b. subjecting portions of the resist layer to high energy radiation, which radiation has a direction, through a mask having passages, which passages correspond in cross-sectional size and shape and in positioning to that of the tapered ends of the funnel-shaped preliminary channels to be subsequently provided, the mask, resist layer and electrode plate forming a unit, which unit is movably positioned in a plane perpendicular to the direction of the high energy radiation and is moved with respect to said plane and said radiation direction during irradiation;

c. providing negatives of the plurality of funnel-shaped preliminary channels on the electrode plate by removing portions of the resist layer to expose portions of the electrode plate;

d. electrodepositing a galvanic layer on the exposed portions of the electrode plate, the galvanic layer thereby defining a plurality of funnel-shaped preliminary channels;

e. planing the galvanic layer; and f. removing the negatives and the electrode plate.

12. The method according to claim 11, wherein the resist layer is composed of a negative resist material and wherein negatives of the funnel-shaped preliminary channels are provided on the electrode plate by removing non-irradiated portions of the resist layer.

13. The method according to claim 11, wherein the resist layer is composed of a positive resist material and wherein negatives of the funnel-shaped preliminary channels are provided on the electrode plate by, in the order recited, removing portions of the resist layer, which portions are irradiated portions, thereby defining preliminary channel zones; filling the preliminary channel zones with a removable filler material; and removing further portions of the resist layer, which further portions are non-irradiated portions.

14. The method according to claim 11, wherein the unit is moved during irradiation by rocking the unit about the plane in at least one direction, whereby the irradiated portions of the resist layer have a trapezoidal funnel shape.

15. The method according to claim 11, wherein the unit is moved during irradiation by tumbling the unit about the plane whereby the irradiated portions of the resist layer have a conical funnel shape.

16. The method according to claim 1, wherein the metal plate having a plurality of spaced-apart preliminary channels defined therethrough is provided by a method including the steps of:

a. providing a resist layer on an electrode plate;

b. subjecting portions of the resist layer to high energy radiation, which radiation has a direction, through a mask having passages, which passages correspond in cross-sectional size and shape and in positioning to that of the tapered ends of the funnel-shaped preliminary channels to be subsequently provided, the mask, resist layer and electrode plate forming a unit, which unit is movably positioned in a plane perpendicular to the direction of the high energy radiation and is moved with respect to said plane and said radiation direction during irradiation;

c. providing negatives of the plurality of funnel-shaped preliminary channels on the electrode plate by removing portions of the resist layer to expose portions of the electrode plate;

d. electrodepositing a galvanic layer on the exposed portions of the electrode plate, the galvanic layer thereby defining a plurality of funnel-shaped preliminary channels;

e. planing the galvanic layer; and f. removing the negatives and the electrode plate.

17. The method according to claim 16, wherein the resist layer is composed of a negative resist material and wherein negatives of the funnel-shaped preliminary channels are provided on the electrode plate by removing non-irradiated portions of the resist layer.

18. The method according to claim 16, wherein the resist layer is composed of a positive resist material and wherein negatives of the funnel-shaped preliminary channels are provided on the electrode plate by, in the order recited, removing portions of the resist layer, which portions are irradiated portions, thereby defining preliminary channel zones; filling the preliminary channel zones with a removable filler material; and removing further portions of the resist layer, which further portions are non-irradiated portions.

19. The method according to claim 16, wherein the unit is moved during irradiation by rocking the unit about the plane in at least one direction, whereby the irradiated portions of the resist layer have a trapezoidal funnel shape.

20. The method according to claim 16, wherein the unit is moved during irradiation by tumbling the unit about the plane, whereby the irradiated portions of the resist layer have a conical funnel shape.

21. The method according to claim 1, wherein the high energy radiation is X-ray radiation generated by an electron synchrotron.

* * * * *